US008959672B2

(12) United States Patent
Dundas et al.

(10) Patent No.: US 8,959,672 B2
(45) Date of Patent: Feb. 24, 2015

(54) TOILET SEAT HINGE WITH SLIDING KEYWAY

(71) Applicants: Garnet Dundas, Wheatley, CA (US); Saverio Paonessa, Belle River, CA (US)

(72) Inventors: Garnet Dundas, Wheatley, CA (US); Saverio Paonessa, Belle River, CA (US)

(73) Assignee: Centoco Plastics Limited, Windsor (CA)

( * ) Notice: Subject to any disclaimer, the term of this patent is extended or adjusted under 35 U.S.C. 154(b) by 262 days.

(21) Appl. No.: 13/709,515

(22) Filed: Dec. 10, 2012

(65) Prior Publication Data

US 2014/0157500 A1 Jun. 12, 2014

(51) Int. Cl.
*A47K 13/12* (2006.01)
*A47K 13/26* (2006.01)

(52) U.S. Cl.
CPC ..... *A47K 13/26* (2013.01)
USPC ..... 4/236

(58) Field of Classification Search
CPC ..... F16B 21/09; A47K 13/12; A47K 13/26
USPC ..... 4/236, 240; 403/53
See application file for complete search history.

(56) References Cited

U.S. PATENT DOCUMENTS

| | | | | |
|---|---|---|---|---|
| 722,624 | A | 3/1903 | Pickop | |
| 3,548,704 | A | 12/1970 | Kutryk | |
| 5,141,354 | A | 8/1992 | Morsbach | |
| 5,716,154 | A | 2/1998 | Miller et al. | |
| 5,933,875 | A | 8/1999 | Hulsebus et al. | |
| 6,070,295 | A | 6/2000 | Hulsebus | |
| 6,381,762 | B1 | 5/2002 | Moser | |
| 6,807,686 | B1 | 10/2004 | Janes | |
| 6,826,803 | B2 | 12/2004 | Twomey | |
| 7,155,748 | B2 | 1/2007 | Vierkant, III et al. | |
| 7,203,975 | B2 | 4/2007 | Vierkant, III | |
| 7,281,276 | B2 | 10/2007 | Vierkant, III et al. | |
| 7,413,371 | B2 * | 8/2008 | Arnold et al. | 403/353 |
| D614,474 | S | 4/2010 | Edwards et al. | |
| 8,209,789 | B2 | 7/2012 | Greenspon | |
| 2006/0064808 | A1 | 3/2006 | Vierkant, III | |
| 2011/0067170 | A1 * | 3/2011 | Greenspon | 4/236 |
| 2012/0110723 | A1 * | 5/2012 | Shih | 4/240 |
| 2012/0167291 | A1 * | 7/2012 | Zhou | 4/236 |

* cited by examiner

*Primary Examiner* — Huyen Le
*Assistant Examiner* — Nicholas Ros
(74) *Attorney, Agent, or Firm* — Dykema Gossett PLLC

(57) ABSTRACT

A toilet seat hinge includes a lock feature to releasably attach the hinge to a bolt head fastened to a toilet bowl. The hinge includes a hinge base, a key plate, and a grip. The hinge base includes a mounting structure to which a toilet seat can be pivotally mounted, as well as an aperture in a bottom surface thereof through which the bolt head can pass. The key plate includes a keyway having a large end that can be aligned with the aperture for insertion of the bolt head and can be slid into a locking position where the small end is aligned with the aperture to retain the bolt head within the hinge base. The user-movable grip includes a guide which travels in an L-shaped slot to restrain movement of the grip to an L-shape (two-movement) for moving the keyway into and out of locking position.

14 Claims, 7 Drawing Sheets

TOILET SEAT HINGE WITH SLIDING KEYWAY

BACKGROUND a. Technical Field

The instant disclosure relates generally to a hinge to releasably attach a toilet seat to a toilet bowl, and more specifically, to a toilet seat hinge with a sliding keyway used to selectively lock and release the hinge to a bolt head affixed to the toilet bowl.

b. Background Art

It is known to provide a toilet seat ring and cover assembly with an integrated hinging mechanism for attachment to a toilet bowl. In this regard, known configurations involve attaching the hinging mechanisms to the bowl using a bolt or the like and a companion fastener. The resulting structure, however, can be difficult to clean, inasmuch as human waste, dust, etc., can accumulate in and around the hinging mechanisms and bolts.

Attempts have been made to improve the above-described known arrangements, at least with respect to ease of cleaning, through the development of a so-called quick-release or releasable hinging mechanism. In a toilet seat assembly with a quick-release hinging mechanism, a pair of specially-configured bolts are first affixed to the toilet bowl, leaving a pair of posts or the like exposed on the top-side of the toilet bowl. The hinging mechanisms are then lowered onto the posts, and are "locked down" by locks incorporated into the hinging mechanisms. When cleaning is desired, the locking process is reversed and the toilet seat assembly removed, leaving only the exposed posts mounted to the toilet bowl. This arrangement facilitates the cleaning process. However, despite these improvements, the lock mechanisms can become loose or unintentionally unlocked.

Accordingly, there remains a need for an improved toilet seat hinge configured for releasable connection to a toilet bowl. Additionally, it should be understood that the foregoing description is intended only to illustrate the present field and is therefore exemplary only and not limiting in nature in any respect.

BRIEF SUMMARY

One advantage of the apparatuses and methods described herein involve providing a toilet seat hinge for making a releasable connection to a toilet bowl that does not require the use of any tools, and, which provides a secure coupling that minimizes or eliminates unintended unlocking or loosening of the hinge from the toilet bowl. In an embodiment, the toilet seat hinge includes a two-movement lock for locking and unlocking the hinge to a bolt head that is in turn fastened to the toilet bowl.

In a further embodiment, a toilet seat hinge is configured to establish a releasable connection to a bolt that is coupled to a toilet bowl. The bolt includes a shank and an enlarged head. The toilet seat hinge includes a hinge base, a key plate, and a grip. The hinge base has a mounting structure configured to be coupled to a toilet seat, which may support a pivotal connection in an embodiment. The hinge base also includes an interior that is bounded by at least a bottom wall. The bottom wall includes an aperture that is configured in at least size and shape to allow the bolt head to pass therethrough to enter to the interior of the hinge base.

The key plate includes a keyway having a first-sized opening configured to allow the bolt head to pass therethrough and a second-sized opening that is smaller than the bolt head. The key plate is configured to slide, relative to the hinge base, along a first axis. The key plate can slide between (i) a first position in which the first-sized opening of the keyway is in registry with the aperture, thereby allowing insertion of the bolt head through the keyway, and (ii) a second position in which the second-sized opening of the keyway is in registry with the aperture. In the second position, the portion of the key plate around the second-sized (smaller) opening is positioned between the bolt head and the aperture, thereby inhibiting withdrawal of the bolt head from the interior of the hinge base. In an embodiment, this prevents the hinge base (including the associated toilet seat) from being removed from the bolt head.

The grip is coupled to the key plate and is slidable along a second axis that is generally perpendicular to the first axis. The grip is movable between a locked position in which the grip holds the key plate in the second position, inhibiting removal, and a retracted position away from the locked position in which the grip does not hold the key plate in the second position. The grip can be further moved along axis that is generally parallel to the first axis, between the retracted position and an unlocked position. In the unlocked position, the bolt head can pass through the keyway and out through the aperture, thereby allowing removal of the hinge from the bolt head.

The foregoing and other aspects, features, details, utilities, and advantages of the present disclosure will be apparent from reading the following description and claims, and from reviewing the accompanying drawings.

DETAILED DESCRIPTION

This disclosure relates to a hinge for use in a toilet seat assembly that allows the toilet seat assembly (e.g., seat and cover) to be quickly and easily installed (i.e., without the need for any tools) and removed from a toilet bowl. The hinge includes an improved locking feature that locks the hinge to a bolt head which minimizes or eliminates unintended unlocking and loosening from the toilet bowl.

Figure 1:
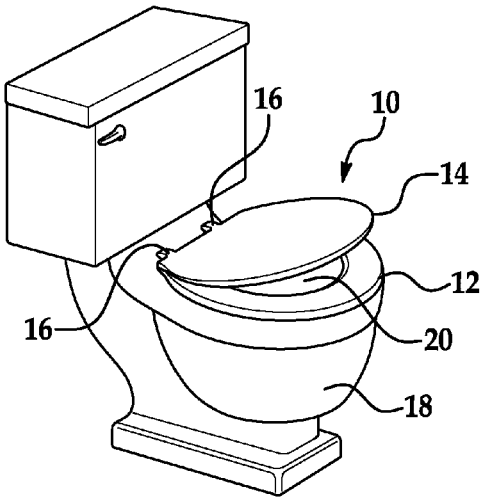
FIG. 1 is a diagrammatic view of a toilet seat assembly coupled to a toilet bowl.

Referring now to the drawings wherein like reference numerals are used to identify identical or similar components in the various views, FIG. 1 is a diagrammatic view of a toilet seat assembly 10 in which the inventive hinge may be used. The toilet seat assembly 10 may include a toilet seat ring 12, a toilet seat cover 14, and one or more toilet seat hinges 16. As shown, toilet seat assembly 10 is configured for attachment to a toilet bowl 18 or a portion thereof (e.g., as shown, the relatively flat portion near the tank, as is conventional practice).

Toilet seat ring 12 may be a closed ring, with a generally oval opening 20, although it should be understood that toilet seat ring 12 may comprise other configurations (e.g., a U-shaped ring configuration with the open portion of the U-shaped ring facing toward the forward part of toilet bowl 18). The construction details of toilet seat ring 12 may comprise any one of a wide variety of conventional configurations. For example, toilet seat ring 12 may have an inner core portion comprising wood, a wood derivative such as a wood flour composite, compressed fiber laminate, or other cellulosic materials such as hemp. The toilet seat ring 12 may further include a polymeric overlay, for example, polypropylene or other suitable alternative material. Toilet seat ring 12 may include further features (not illustrated), such as multiple bumpers on a lower surface facing the toilet bowl, for example.

Toilet seat cover 14 conceals opening 20 when toilet bowl 18 is not being used, and may have a similar construction (e.g., core in combination with an overlay) as ring 12, or may be a solid construction, or may be constructed in other ways known in the art.

Toilet seat ring 12 and toilet seat cover 14 may both include further features to provide for a pivotal connection with hinges 16. For example only, both ring 12 and cover 14 may each include hinge ears (not shown) configured for attachment to a respective one of hinges 16. Further details of an exemplary toilet seat ring and cover may be seen by reference to U.S. Pat. No. 6,640,349 entitled "TOILET SEAT", application Ser. No. 09/921,069 filed 2 Aug. 2001, owned by the common assignee of the present invention, and hereby incorporated by reference in its entirety as though fully set forth herein.

Figure 2:
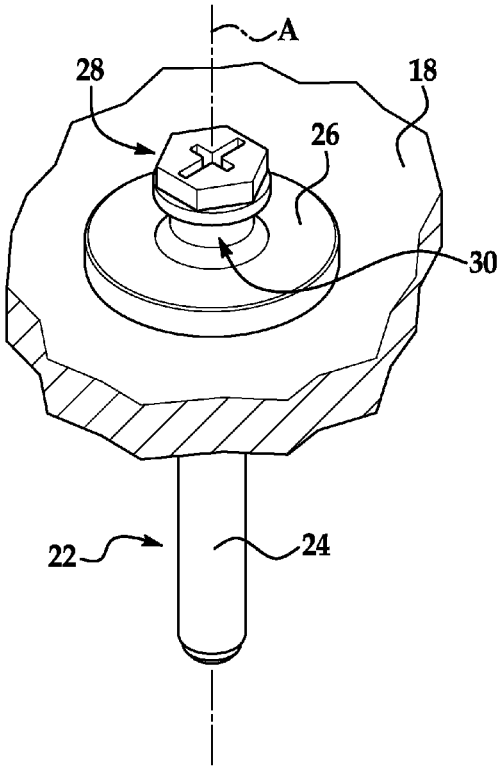
FIG. 2 is a diagrammatic view of a bolt fastened to a toilet bowl and on which an embodiment of a hinge can be attached.

FIG. 2 shows an embodiment of a bolt 22 as fastened to toilet bowl 18. Each toilet seat hinge 16 is configured to be releasably attached and detached from bolt 22. Bolt 22 includes a shank 24 extending along an axis designated "A", a washer portion 26, an enlarged head 28, and a circumferentially extending groove 30 disposed between washer portion 26 and enlarged head 28. In this regard, washer portion 26 is longitudinally offset from enlarged head 28 to thereby define groove 30 therebetween.

Figure 3:
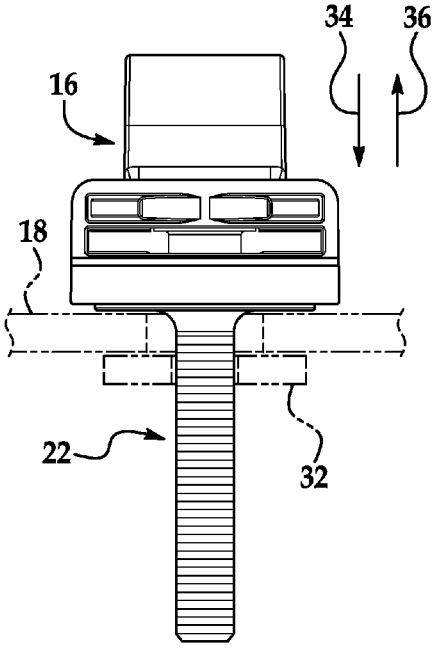
FIG. 3 is a cross-sectional view of the bolt of FIG. 2, with an embodiment of a hinge attached thereto.

FIG. 3 is a cross-sectional view of bolt 22 fastened to toilet bowl 18. As shown, shank 24 can be constructed with external (male) threads that are configured to cooperate with a fastener 32 having corresponding internal (female) threads. Bolt 22 can be therefore fastened to and retained to toilet bowl 18. As shown, washer portion 26 is larger in size (e.g., diameter) than the size (e.g., diameter) of the through-hole extending through toilet bowl 18, which prevents the bolt 22 from passing completely through.

As shown in FIGS. 2-3, the portion of bolt 22 above the top surface of toilet bowl 18 provides a fixed stud onto which hinge 16 can be removably attached and detached, for example, to make cleaning the toilet bowl area easier. Once bolt 22 has been fastened to toilet bowl 18, hinge 16 can be attached to toilet bowl 18 by first lowering, generally in a direction designated 34, hinge 16 over and onto bolt head 28. Hinge 16 can thereafter be "locked" onto bolt 22 so as to prevent removal of hinge 16—and the remainder of the toilet seat assembly 10—from toilet bowl 18. When removal of hinge 16 including the remainder of the toilet seat assembly 10 is desired, the reverse process is performed, namely, "unlocking" hinge 16 and then lifting hinge 16 and the rest of toilet seat assembly generally in the direction designation 36. The locking and unlocking process, and the underlying enabling structure in hinge 16, will be described below.

Figure 4:
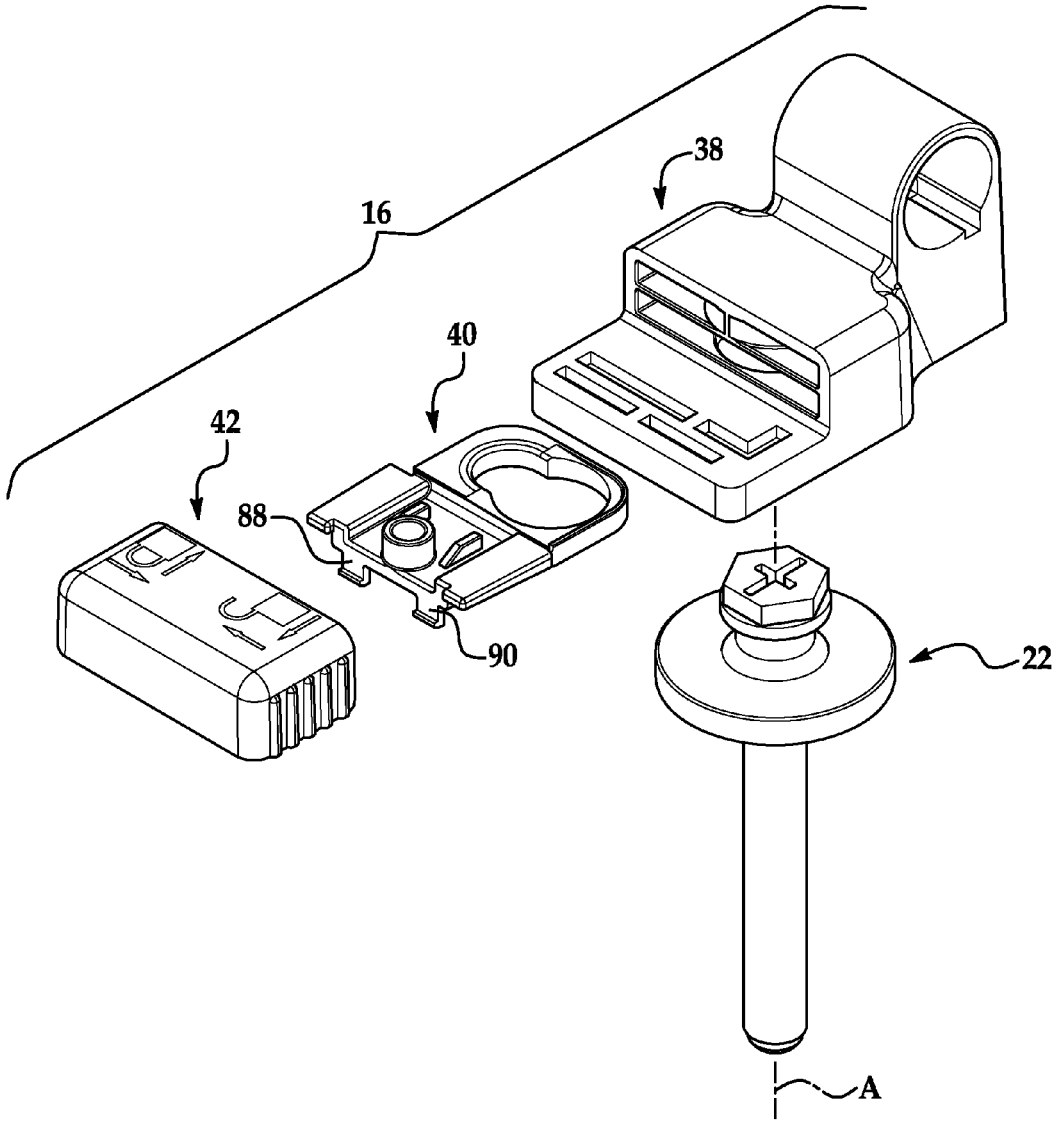
FIG. 4 is an isometric, exploded view of the hinge of FIG. 3, shown in relation to the bolt of FIG. 2.

FIG. 4 is an isometric, exploded view of the constituent components of hinge 16, shown in relation to bolt 22. In an embodiment, hinge 16 includes a hinge base 38, a key plate 40, and a grip 42. These three components 38, 40, 42 cooperate to provide a user-operated 2-movement locking and unlocking process. Each of these components will be described in turn in connection with FIGS. 5-8, followed by a description of the overall method of operation in connection with FIGS. 9A-11C. Components 22 (bolt), 38, 40, and 42 may each comprise conventional molding polymers, such as conventional injection molding polymers.

Figure 5:
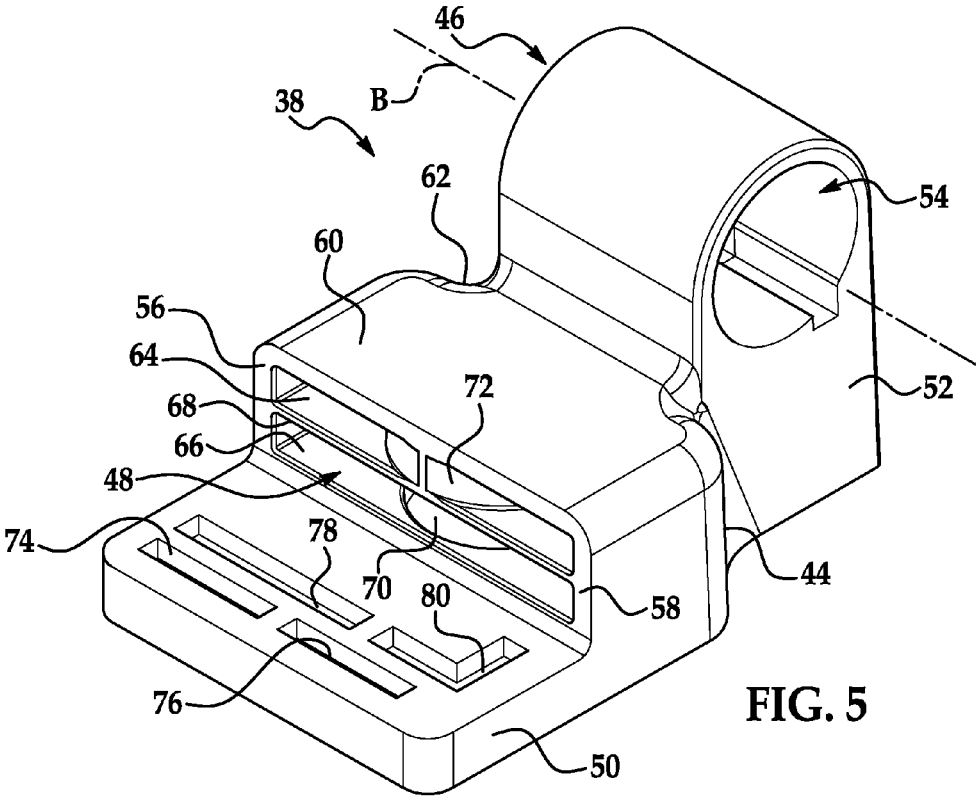
FIG. 5 is an isometric view showing, in greater detail, an embodiment of a hinge base shown in FIG. 4.

FIG. 5 is an enlarged isometric view of the hinge base 38 in FIG. 4. Hinge base 38 is configured generally to provide the mechanical coupling of the toilet seat assembly to toilet bowl 18. Hinge base 38 includes a main body 44 having a mounting structure 46, an interior 48 and a bottom wall 50.

Mounting structure 46 is configured to couple toilet seat ring 12 and toilet seat cover 14 to hinge base 38. The coupling may be provided in the form of a pivotal coupling. In the illustrated embodiment, mounting structure 46 includes a base 52 that extends in an arch shape and forms a horizontally-arranged bore 54. Bore 54 extends along an longitudinal axis designated "B". Bore 54 is configured to receive a pivot (not shown) or the like configured to be joined to hinge ears on toilet ring 12 and/or toilet cover 14. It should be understood that the foregoing is exemplary only and not limiting in nature.

Interior 48 is bounded by at least bottom wall 50 and in the illustrated embodiment is further bounded by a first sidewall 56 extending from bottom wall 50, a second sidewall 58 also extending from bottom wall 50, a top wall 60 and a back wall 62. Interior 48 is subdivided into an upper compartment 64 and a lower compartment 66 separated by a partition (wall) 68. Access to interior 48 is provided through an aperture 70 extending through bottom wall 50. Aperture 70 is configured in size to allow enlarged head 28 of bolt 22 to pass therethrough. Hinge base 38 further includes a closure 72 formed in upper compartment 64. Closure 72 is configured in size and shape to receive head 28 of bolt 22 whose ceiling establishes an upper limit of travel (stop) for bolt head 28.

Bottom wall 50 includes a main exposed portion next to interior 48, which includes first and second key plate slots 74, 76, a straight slot 78, and an L-shaped slot 80. Slots 74, 76, are configured to receive corresponding tabs on key plate 40 for coupling hinge base 38 and key plate 40 together and guiding the movement of key plate 40 in the direction of slots 74, 76. Likewise, slots 78, 80 are provided to receive corresponding mechanical features on grip 42 for guiding the movement of grip 42 in directions permitted by L-shaped slot 80. While slots 74, 76, 78, and 80 are illustrated as through-slots (i.e., they extend through the thickness of bottom wall 50), variations are possible.

Figure 6:
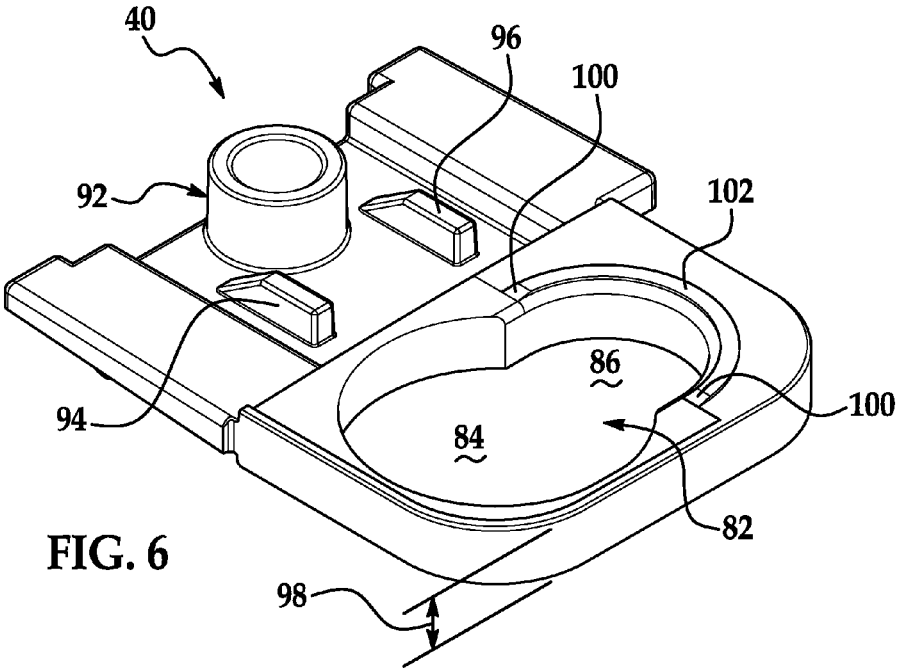
FIG. 6 is an isometric view showing, in greater detail, an embodiment of a key plate shown in FIG. 4.

FIG. 6 is an enlarged isometric view of the embodiment of key plate 40 in FIG. 4. Key plate 40 includes a keyway 82 having a first-sized opening 84 at one lateral end and a second-sized opening 86 at the opposite lateral end. Key plate 40 is configured generally to selectively (i) receive and allow withdrawal of bolt head 28 from hinge base 38, and (ii) retain and lock bolt head 28 in hinge base 38, to prevent withdrawal of bolt head 28. In this regard, the keyway portion of key plate 40 is configured in size and shape to be received in the lower compartment 66, as best shown in FIG. 5. Key plate 42 is configured generally to slide, relative to hinge base 38, along a first axis (i.e., in the general direction of slots 74, 76) between a first position, in which the first-sized opening 84 is aligned with or in registry with aperture 70, and a second position, in which the second-sized opening 86 is aligned with or in registry with aperture 70.

First-sized opening 84 configured in size to allow bolt head 28 to pass therethrough, while second-sized opening 86 that is smaller than bolt head 28. Thus, when key plate 40 is in the first position, the resulting configuration allows insertion of bolt head 28 through aperture 70 and further through first-sized opening 84, reaching a final destination residing in closure 72. While bolt head 28 is inserted in hinge base 38, key plate 40 can be moved away from the first position to the second position, wherein the second-sized opening (smaller) of keyway 82 is below bolt head 28, and therefore interposed between bolt head 28 and aperture 70. In the second position, keyway 82 retains and locks hinge base 38 to bolt 22. In other words, since in the second position bolt head 28 cannot be withdrawn from closure 72 through keyway 82 and aperture 70, bolt 22 and hinge base 38 are locked together. In an embodiment, key plate 40 further includes inclined portions 100 and a land 102. The inclined portions 100 facilitate movement of key plate 40 to a position below the bolt head 28, wherein bolt head 28 rests on land 102.

Key plate 40 further includes first and second tabs 88, 90 (best shown in FIG. 4). Tabs 88, 90 are configured to be received and retained in slots 74, 76 of hinge base 38, which allow for guided and sliding movement of key plate 40. Tabs 88, 90 each include a respective lip at an extreme distal end which are adapted to resiliently overhang the corners of slots 74, 76 on the underside (bottom) surface of bottom wall 50 (shown, for example, in FIG. 9C). This feature retains key plate 40 on hinge base 38, but allows the sliding movement as described herein.

Key plate 40 further includes a cylindrical projection 92 which, when used in combination with a fork 126 (FIGS. 7-8), form a detent feature 140 configured to selectively retain grip 42 in a locked position. Stand-offs 94, 96 provide a platform upon which the legs of fork 126 can rest when grip 42 is in the locked position. The keyway portion of key plate 40 has a thickness 98, which, in an embodiment, (i) is no larger than an axial height of circumferential groove 30 of bolt 22, and (ii) is no larger than a height of lower compartment 66.

Figure 7:
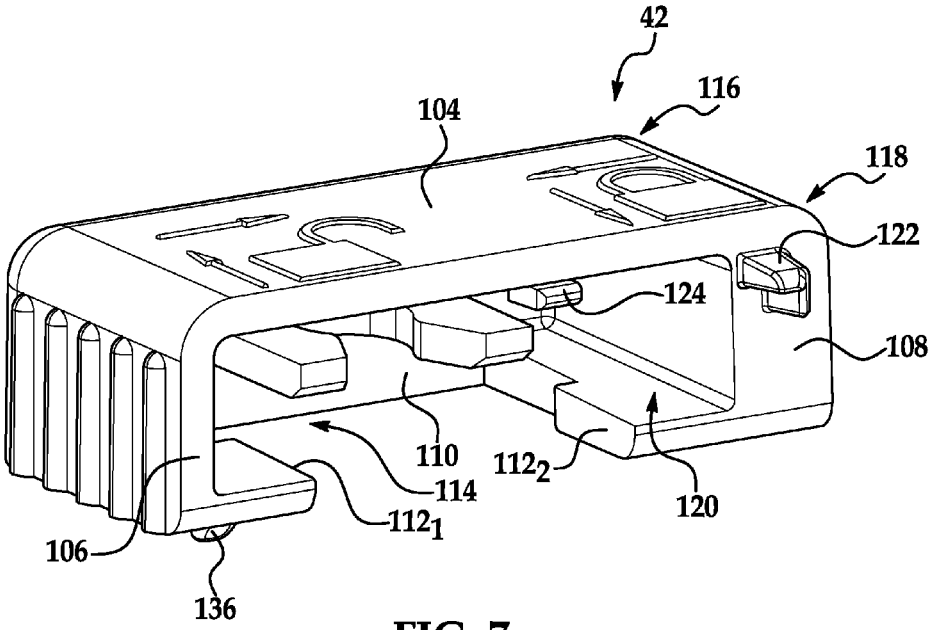
FIG. 7 is an isometric view showing, in greater detail, an embodiment of a grip shown in FIG. 4.

FIG. 7 is an enlarged isometric view of the embodiment of grip 42 in FIG. 4. Grip 42 is configured for user-effected movement (i.e., a user grasps grip 42 with his or her hand) for purposes of locking or unlocking bolt head 28 to hinge 16. In the illustrated embodiment, grip 42 is generally rectangular in shape and includes a top wall 104, a first side wall 106, a second side wall 108, a back wall 110, and a bottom wall 112 having first segment $\mathbf{112}_1$ and second segment $\mathbf{112}_2$ separated by an intervening bottom passage 114. Grip 42 further includes a closed end 116 and an open end 118 having an end opening 120. Grip 42 also includes a locking post 122 configured to inhibit movement of key plate 40, as will be described below in greater detail. Grip 42 also includes a pair of tabs 124 (only one shown—one on each side of grip 42) that are used for the pre-assembly of key plate 40 and grip 42. Tabs 124 prevent vertical movement of key plate 40 within grip 42 while the grip 42 and key plate 40 are being installed on hinge base 38.

Figure 8:
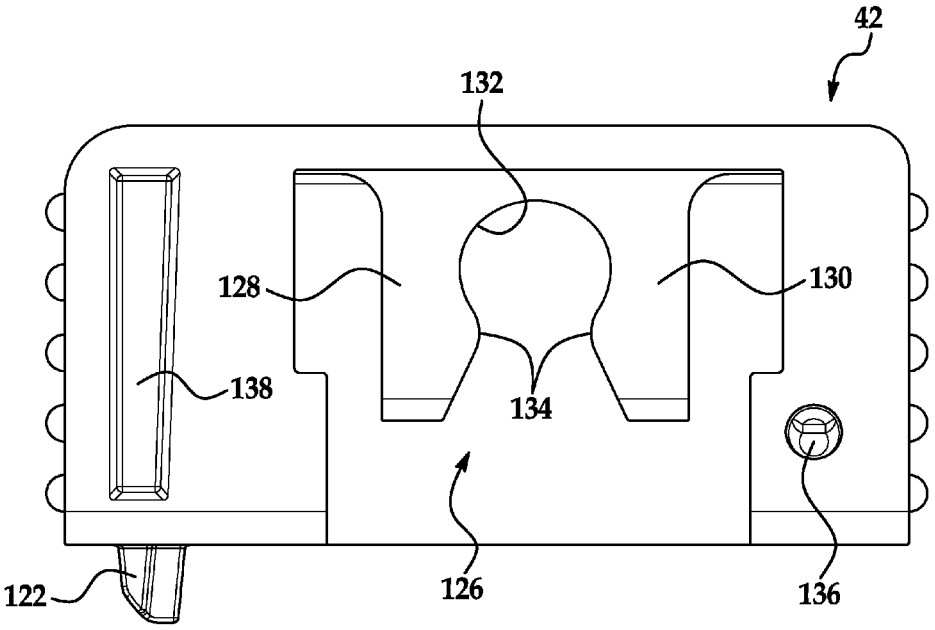
FIG. 8 is a bottom view of the grip of FIG. 7.

FIG. 8 is a bottom view of grip 42. The bottom view shows that grip 42 includes a detent fork 126 including legs 128 and 130. Fork 126 further includes a central aperture 132 which corresponds in size and shape to cylindrical projection 92. Each of legs 128, 130 includes a respective detent feature 134, located at a mid-position along the leg. Grip 42 also includes a guide 136, which projects outwardly from the bottom surface of grip 42. Feature 138 is a core out for injection molding purposes, and is present in order to prevent a thick section of material in this area.

Referring now to FIGS. 4-8, to assemble hinge 16, the keyway portion of key plate 40 is inserted into lower compartment 66 and tabs 88, 90 are inserted into slots 74, 76. Key plate 40 is thus secured to hinge base 38, but is able to slidably move side-to-side (i.e., between the first and second positions). Grip 42 is thereafter assembled to the hinge base/key plate combination, with open end 118 facing upper and lower compartments 64, 66. Fork 126 snaps onto cylindrical projection 92, and guide 136 is seated in L-shaped slot 80.

Figure 9A:
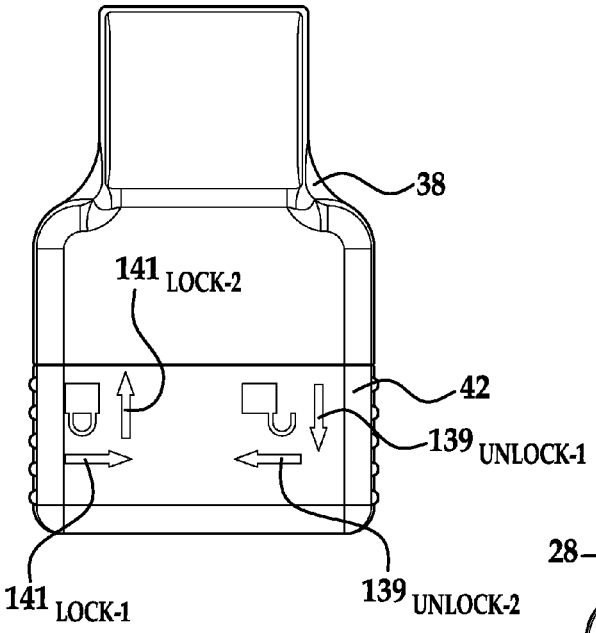
FIGS. 9A-9C illustrate the hinge of FIG. 4 as assembled in a locked position, and respectively showing the hinge in a top view, in a top view with portions broken away, and in a bottom view.
Figure 9B:
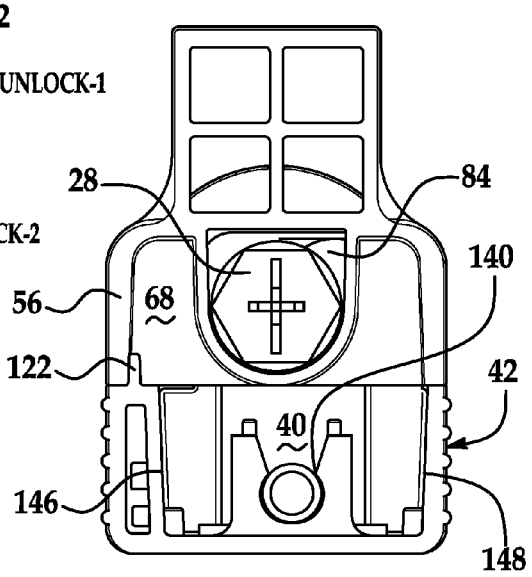
Figure 9C:
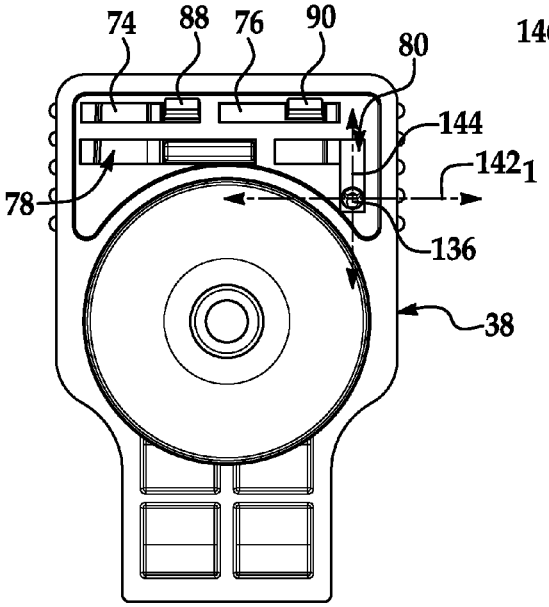

FIGS. 9A-9C illustrate hinge 16 in a locked position, with FIG. 9A in particular being a top view of hinge 16. FIG. 9B is also a top view of hinge 16 but with portions broken away to show the particular arrangement of hinge base 38, key plate 40, and grip 42 (as assembled) with respect to each other . Before proceeding to a description of the overall operation of hinge 16, recall that key plate 40 can slidably move between (i) a first position where first-sized (larger) opening 84 of keyway 82 is in alignment with aperture 70 (e.g., to allow insertion of bolt head 28 into hinge base 38), and (ii) a second position where second-sized (smaller) opening 86 of keyway 82 is in alignment with aperture 70 (e.g., to block withdrawal of bolt head 28 from hinge base 38).

With continued reference to FIG. 9B, keyway 82 is positioned in lower compartment 66 when hinge 16 is assembled. When hinge 16 is locked, key plate 40 is in the second position where the second-sized (smaller) opening 86 is positioned below bolt head 28, which prevents removal of hinge base 38 from bolt head 28. Hinge base 38 can be removed from bolt 22 but only when key plate 40 is moved so that the first-sized (larger) opening 84 is positioned around bolt head 28. As shown, however, in the locked position, grip 42 prevents key plate 40 from moving away from the second position into the first position, as would be needed for withdrawal. This situation prevails because key plate 40 mechanically engages grip 42 at several points (e.g., at the engagement surfaces designated 146, 148), and grip 42, in turn, engages hinge base 38 by way of locking post 122 engaging sidewall 56.

FIG. 9C is a bottom view of hinge 16, also in the locked position. Guide 136, which extends from the bottom of grip 42, is positioned within L-shaped slot 80, as shown. Accordingly, side-to-side movement of grip 42 along axis $\mathbf{142}_1$, for example as would be needed to move key plate 40 to the first position (withdrawal position), is currently precluded because guide 136 must stay within slot 80 and slot 80 does not allow movement in this direction (along axis $\mathbf{142}_1$). However, slot 80 does allow movement of guide 136 in a second axis 144 that is generally perpendicular to axis $\mathbf{142}_1$.

Figure 10A:
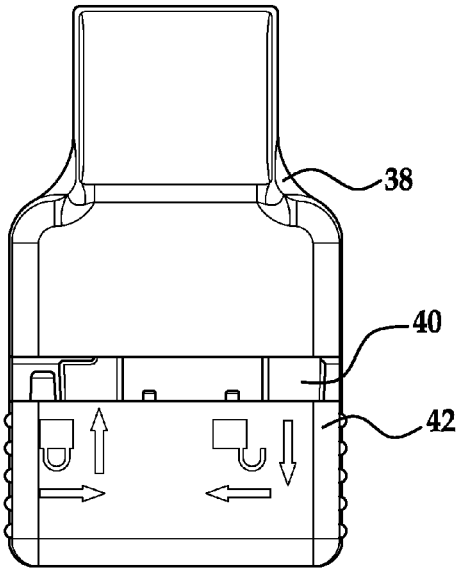
FIGS. 10A-10C illustrate the hinge of FIG. 4 as assembled in a retracted position, and respectively showing the hinge in a top view, in a top view with portions broken away, and in a bottom view.
Figure 10B:
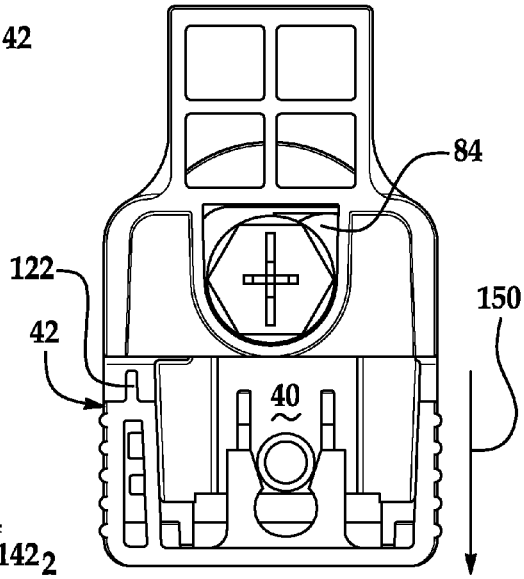
Figure 10C:
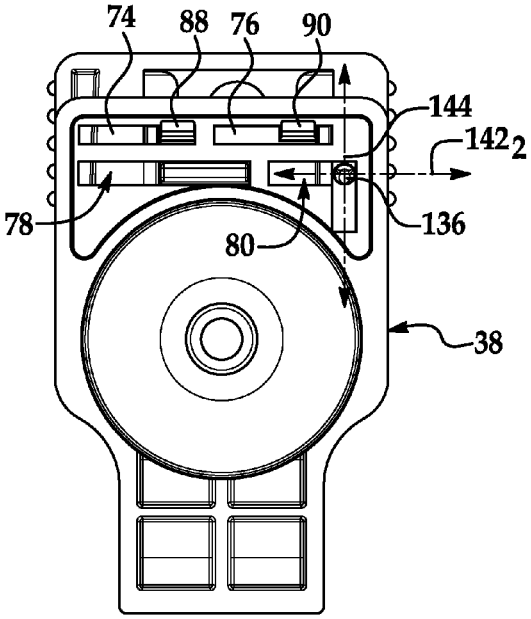

FIGS. 10A-10C illustrate hinge 16 in a retracted position, with FIG. 10A in particular being a top view of hinge 16. FIG. 10B is also a top view of hinge 16 but with portions broken away to more clearly show the particular arrangement of hinge base 38, key plate 40, and grip 42. When the user wishes to unlock hinge 16, the user first retracts grip 42 from the locked position, and then moves grip 42 laterally (i.e., to the left in FIG. 11B) to an unlocked position to unlock hinge 16, which allows the hinge base 38 to be removed from bolt 22.

With reference now to FIGS. 9B-10B, detent feature 140 is configured to retain grip 42 in the locked position, but is also configured to release grip 42 from the locked position when a force exceeding a threshold is applied by the user in the direction designated 150 (FIG. 10B). As shown in FIG. 10B, retracting grip 42 also withdraws locking post 122 from upper compartment 64, thereby dis-engaging locking post 122 from contact with sidewall 56. As shown in FIG. 10C, which is a bottom view of hinge 16, guide 136 has moved within slot 80 along axis 144 to a new position.

Figure 11A:
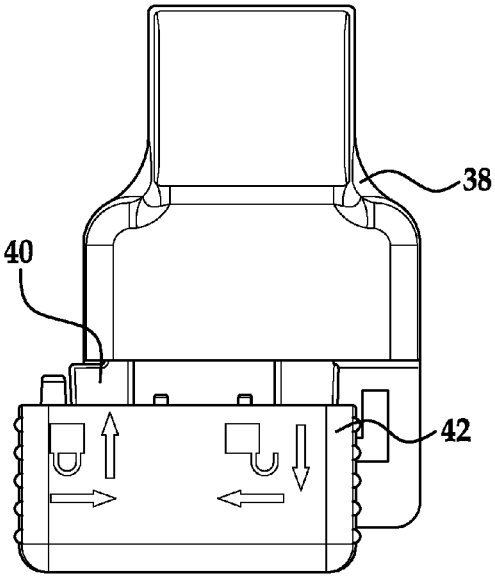
FIGS. 11A-11C illustrate the hinge of FIG. 4 as assembled in an unlocked position, and respectively showing the hinge in a top view, in a top view with portions broken away, and in a bottom view.
Figure 11B:
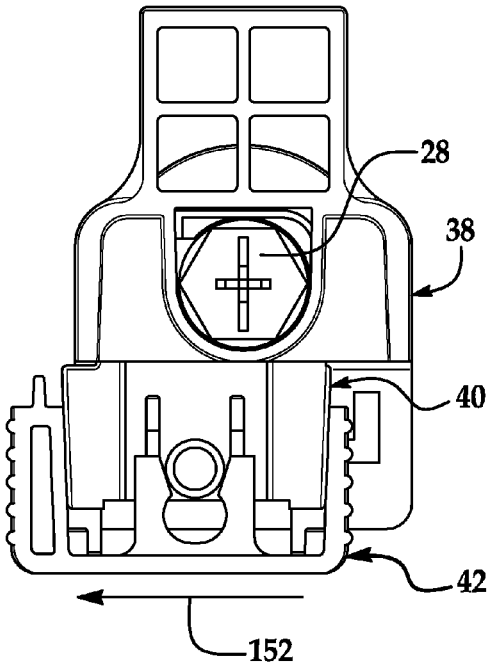
Figure 11C:
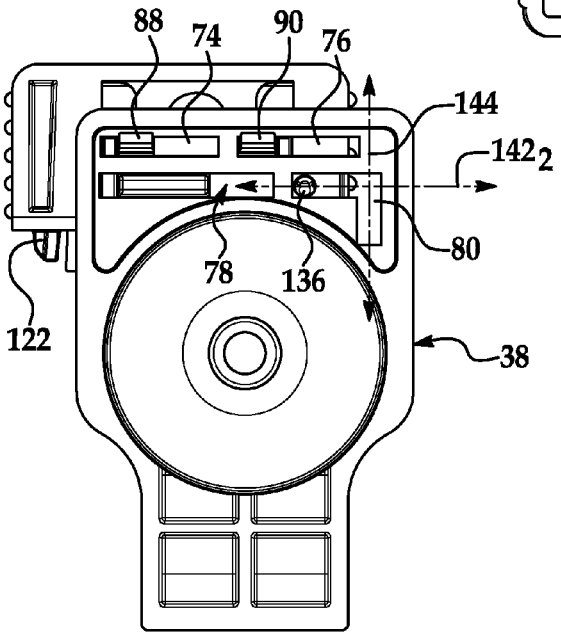

FIGS. 11A-11C illustrate hinge 16 in an unlocked position, with FIG. 11A being a top view of hinge 16. FIG. 11B is a top view with portions broken away to show the particular arrangement of hinge base 38, key plate 40, and grip 42 with respect to each other. The user unlocks hinge 16 by moving grip 42 in the direction designated 152. As shown in FIG. 11C, which is a bottom view of hinge 16, guide 136 can now move and has moved along an axis $\mathbf{142}_2$, which is parallel to the axis along which key plate 40 needs to move in order for the first-sized (larger) opening 84 of keyway 82 to be aligned with aperture 70 (i.e., for withdrawal of hinge base 38 from bolt 22). As also shown in FIG. 11C, tabs 88, 90 have moved reflecting the movement of key plate 40. At this point, the user can lift hinge 16 off of bolt 22, for cleaning or other maintenance of toilet bowl 18.

In sum, hinge 16 is configured to provide a 2-movement locking and unlocking mechanism. As shown in FIG. 9A, grip 42 may be configured to include human discernible indicia reflecting the needed movements to effect unlocking (i.e., the unlocked lock icon) and locking (i.e., the locked lock icon) operations.

To unlock hinge 16 already in a locked condition, a user moves grip 42 in a first direction, as indicated by indicia arrow $\mathbf{139}_{UNLOCK\text{-}1}$, and then moves grip 42 in a second direction, as indicated by indicia arrow $\mathbf{139}_{UNLOCK\text{-}2}$. At this point, the hinge(s) 16 can be removed from bolts 22, allowing the now-exposed area to be cleaned, for example. Likewise, when hinge 16 is already unlocked, a user can lock hinge 16 by moving grip 42 in a first direction, indicated by indicia arrow $\mathbf{141}_{LOCK\text{-}1}$, and then by moving grip 42 in a second direction, indicated by indicia arrow $\mathbf{141}_{LOCK\text{-}2}$. At this point, hinge(s) 16 have been locked in place onto bolts 22, thereby preventing removal therefrom.

While one or more particular embodiments have been shown and described, it will be understood by those of skill in the art that various changes and modifications can be made without departing from the spirit and scope of the present teachings.

What is claimed is:

1. A toilet seat hinge configured for releasable connection to a bolt coupled to a toilet bowl wherein said bolt includes a shank and an enlarged head, comprising:

a hinge base having a mounting structure configured to be coupled to a toilet seat and an interior bounded by at least a bottom wall thereof, said bottom wall including an aperture configured to allow access to said interior;

a key plate including a keyway having a first-sized opening configured to allow said bolt head to pass therethrough and a second-sized opening that is smaller than said bolt head, said key plate being configured to slide, relative to said hinge base, along a first axis, between (i) a first position in which said first-sized opening is in registry with said aperture, thereby allowing insertion of said bolt head therethrough, and (ii) a second position in which said second-sized opening is in registry with said aperture, said key plate in said second position being interposed between said bolt head and said aperture, thereby inhibiting withdrawal of said bolt head from said interior; and a grip coupled to said key plate and slidable along a second axis generally perpendicular to said first axis between a locked position in which said grip holds said key plate in said second position and a retracted position, away from said locked position, in which said grip does not hold said key plate in said second position, said grip being further slidable along a third axis generally parallel to said first axis, between said retracted position and an unlocked position, in which said key plate is in said first position.

2. The hinge of claim 1 wherein said bolt includes a washer portion longitudinally offset from said head so as to form a circumferential groove therebetween, said key plate having a thickness associated therewith around said keyway no larger than said groove.

3. The hinge of claim 1 wherein mounting structure is configured for pivotal connection of said toilet seat.

4. The hinge of claim 1 wherein said hinge base includes upper and lower compartments separated by a partition.

5. The hinge of claim 4 wherein said upper compartment is bounded at least in part by a pair of sidewalls, said grip having an open end that faces said upper and lower compartments, said grip further including a locking post extending from said open end thereof into said upper compartment and engaging one of said sidewalls when said grip is in said locked position.

6. The hinge of claim 5 wherein said locking post is when said grip is moved from said locked position to said retracted position, said locking post is withdrawn from said upper compartment away from said engagement with said one sidewall.

7. The hinge of claim 5 further comprising a detent feature configured to selectively retain said grip in said locked position, said detent feature being further configured to release said grip from said locked position when a force on said grip applied in a direction away from said locked position exceeds a threshold.

8. The hinge of claim 7 wherein said detent feature comprises a cylindrical-shaped projection extending from said key plate and a complementary receiving fork on said grip, said fork including a centrally-disposed cylindrical-shaped hole with detent features configured to retain said cylindrical-shaped projection in said hole, thereby coupling said grip and said key plate together.

9. The hinge of claim 1 wherein said bottom wall of said hinge base includes first and second through-slots, said key plate further including a corresponding pair of tabs with respective lips on a distal end thereof configured to be disposed in said through-slots.

10. The hinge of claim 9 wherein said lips of said tabs are configured to overhang respective edges of said first and second through-slots, thereby coupling said key plate to said bottom wall of said hinge base, said first and second tabs being configured to slide in said first and second through-slots, thereby allowing sliding movement of said key plate between said first and second positions.

11. The hinge of claim 1 wherein said bottom wall of said hinge base includes an L-shaped through-slot having first and second legs thereof, said grip further including a guide projecting from a bottom surface thereof and configured to travel within said L-shaped through-slot.

12. The hinge of claim 11 wherein said guide and said L-shaped through-slot cooperate to guide movement of said grip between said locked position, said retracted position, and said unlocked position.

13. A toilet seat hinge configured for releasable connection to a bolt coupled to a toilet bowl wherein said bolt includes a shank and an enlarged head, comprising:

a hinge base configured for pivotal connection to a toilet seat, said hinge base further including an aperture on a bottom surface thereof configured to allow said bolt head to pass therethrough into said hinge base;

a lock configured to selectively lock and retain said hinge base to said bolt head, said lock including, a key plate including a sliding keyway having a first opening at a first end configured to allow said bolt head to pass therethrough and a second opening at a second end opposite the first end that is smaller than said bolt head; and a grip configured to move said key plate, said grip being movable to an unlocked position where said first keyway opening is in registry with said aperture to thereby allow insertion of said bolt head, said grip being further movable in a first direction from said unlocked position to a retracted position, said grip being further movable, in a second direction perpendicular to said first direction, from said retracted position to a locked position configured to hold said keyway so that said second, smaller opening remains engaged with said bolt so as to inhibit removal of said bolt head from said hinge base.

14. The toilet seat hinge of claim 13, wherein said lock is configured to allow removal of said hinge base from said bolt head by moving said grip in said second direction from said locked position to said retracted position, and by moving said grip in said first direction from said retracted position to said unlocked position.

* * * * *